US007594617B2

(12) United States Patent
Kaess et al.

(10) Patent No.: US 7,594,617 B2
(45) Date of Patent: Sep. 29, 2009

(54) SHOWER ATTACHMENT

(75) Inventors: Henning Kaess, Bodman-Ludwigshafen (DE); Paul Boesch, Lichtensteig (CH); Kurt Kremm, Wildberg (DE)

(73) Assignees: Weidman Plastics Technology AG, Rapperswil (CH); Hansa Metallwerke AG, Stuttgart (DE)

( * ) Notice: Subject to any disclaimer, the term of this patent is extended or adjusted under 35 U.S.C. 154(b) by 0 days.

(21) Appl. No.: 12/065,431

(22) PCT Filed: Aug. 25, 2006

(86) PCT No.: PCT/CH2006/000461

§ 371 (c)(1),
(2), (4) Date: Feb. 29, 2008

(87) PCT Pub. No.: WO2007/025403

PCT Pub. Date: Mar. 8, 2007

(65) Prior Publication Data

US 2008/0217434 A1 Sep. 11, 2008

(30) Foreign Application Priority Data

Aug. 30, 2005 (EP) ..... 05405500

(51) Int. Cl.
*B05B 1/30* (2006.01)
*B05B 15/08* (2006.01)
*B05B 1/36* (2006.01)

(52) U.S. Cl. ..... 239/579; 239/193; 239/393; 239/395; 239/397; 239/446; 239/447; 239/587.1; 239/587.5

(58) Field of Classification Search ..... 239/16, 239/17, 193, 390–397, 436, 442–444, 446–449, 239/579, 587.1, 587.5, 587.6
See application file for complete search history.

(56) References Cited

U.S. PATENT DOCUMENTS

| | | | | |
|---|---|---|---|---|
| 3,524,591 | A | 8/1970 | Samuels et al. | |
| 5,201,468 | A | 4/1993 | Freier et al. | |
| 5,765,760 | A * | 6/1998 | Kuo | 239/440 |
| 2004/0251325 | A1 | 12/2004 | Schmidt | |

FOREIGN PATENT DOCUMENTS

| | | |
|---|---|---|
| GB | 1334401 | 10/1973 |
| GB | 2048721 | 12/1980 |

* cited by examiner

*Primary Examiner*—Darren W Gorman
(74) *Attorney, Agent, or Firm*—Sughrue Mion, PLLC

(57) ABSTRACT

The invention relates to a shower attachment which comprises a first part (T1) which comprises a water guiding channel (2), and a second part (T2) which comprises at least one first and one second outlet opening (A1, A2) which can be selectively connected to the water guiding channel (2) by means of a valve (V). Said valve (V) is embodied by areas (BI, B2) of the two parts (TI, T2), which are connected to each other in a manner such that they can be displaced and are arranged in the inside of the second part (T2). The valve (V) can be changed by displacing at least one part (T2), and the both known areas (B1, B2) are connected together in such a manner that they can pivot. The first part (T1) comprises a pivotable axis (24) and at least one outlet opening (7) which is arranged at a distance therefrom. The second part (T2) comprises, optionally, at least two inlet openings which are arranged at a distance in relation to said pivotable axis (24).

23 Claims, 4 Drawing Sheets

SHOWER ATTACHMENT

Figure 1:
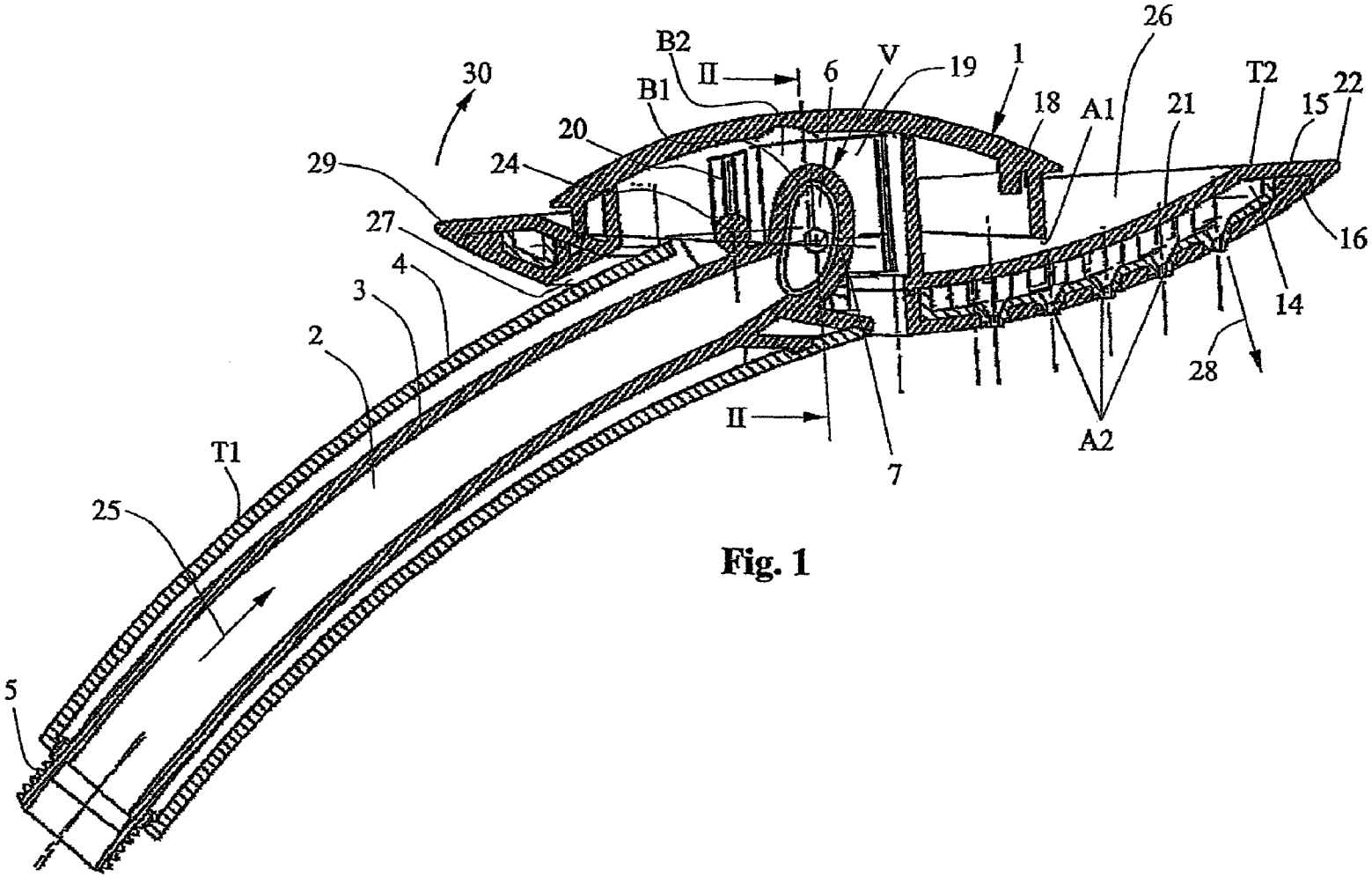

The invention relates to a spray attachment comprising a first part, which is to be connected to a water conduit and has a water guiding channel, and comprising a second part, which has at least a first and a second exit opening, which can be selectively connected to the water guiding channel of the first part by means of a valve, the valve being able to be switched over by a movement of the second part with respect to the first part.

Switchable spray attachments have long been known, in particular as shower attachments for baths and as spray attachments for washing dishes. With these, it is possible to use an actuating element to switch over, for example, between two types of jet. The actuating element is, for example, a lever which can be actuated by hand and is connected to a displaceable valve body. Depending on the position of the valve body, the water in the water guiding channel is directed to one or the other exit openings.

A spray attachment of the stated type is disclosed by DE 102 19 943. In the case of the embodiment shown in FIG. 3 of this document, the first part forms an fastening part, which is to be connected to a shower hose and is displaceably fastened on a shower sliding rail. The second part forms a functional part, which can be turned by 180° about a longitudinal axis of the first part to switch over the valve. The valve is formed by end faces of the first part and of the second part which run perpendicularly in relation to the axis of rotation about which the second part can be turned for switching over the valve.

A further spray attachment is disclosed by DE 198 03 554 A. To actuate the valve, the spray attachment has a two-armed lever, which is arranged underneath a membrane. The lever is connected to a closure element, which can be adjusted between two positions by pivoting said lever. This spray attachment comprises a comparatively large number of individual parts.

The invention is based on the object of providing a further spray attachment of the stated type.

The object is achieved in the case of a spray attachment of the generic type as claimed in claim 1.

In the case of the spray attachment according to the invention, the valve is located inside the second part. This permits a compact construction and production with few individual parts.

A particularly compact construction and simple switching over of the valve are obtained if, according to a development, the two said parts are pivotably connected to each other. The valve can in this case be switched over by pivoting the second part.

According to a development of the invention, it is provided that the first part forms a pivot spindle for the pivoting of the second part and has at least one exit opening at a distance from said spindle and that the second part has at least two entry openings, likewise at a distance from this pivot spindle. The exit opening can consequently be connected selectively to one or the other entry opening by pivoting one part.

According to a development of the invention, it is provided that the first part has at least two exit openings, which are connected to the water guiding channel, and that the second part has at least four entry openings, two exit openings respectively being able to be connected to two entry openings. This makes it possible to make the cross sections of these openings, and consequently the overall height of the valve, smaller.

Instead of a single exit opening, consequently a number of exit openings are provided, the water that flows through being divided among them.

According to a development of the invention, it is provided that the valve has a valve part with at least one exit opening and that the second part has a valve part with a slider with at least one entry opening and that the two valve parts are displaceable or pivotable with respect to each other. Such a slider permits suitable guidance of the movable second part on the first part.

According to a development of the invention, it is provided that the second part has an opening in which a front end of the first part engages. The valve can, as a result, be integrated particularly easily into the second part. Since the valve is located in the second part, the first part can be made more slender than before.

A particularly simple and functionally reliable construction is obtained if, according to a development of the invention, the valve is arranged inside an opening of the second part. This opening is preferably formed in such a way that it permits pivoting of the second part with respect to the first part.

Particularly simple and functionally reliable switching over of the valve is possible when, for switching over the valve, the second part is pivoted about a spindle which runs substantially perpendicularly in relation to the direction of flow of the water in the water guiding channel of the first part. This permits, in particular, switching over by pivoting the second part by a comparatively small angle, according to the present invention less than 90° and in particular less than 45°.

The second part may in principle also have more than two outlet openings, but preferably only two outlet openings are provided.

Particularly simple switching over is possible when the second part forms a spray head and the valve can be switched over by moving the spray head, and in particular by a tipping movement.

Figure 2:
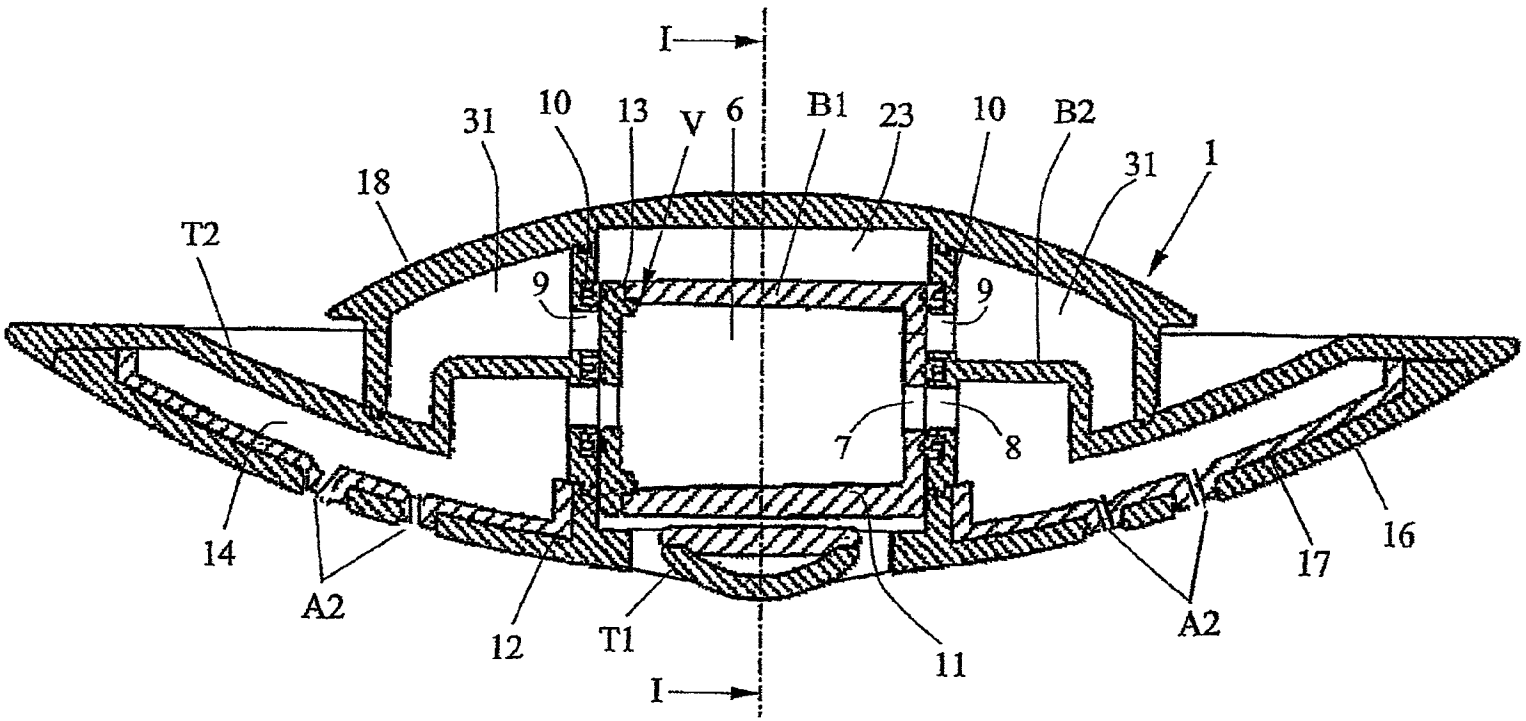
Figure 3:
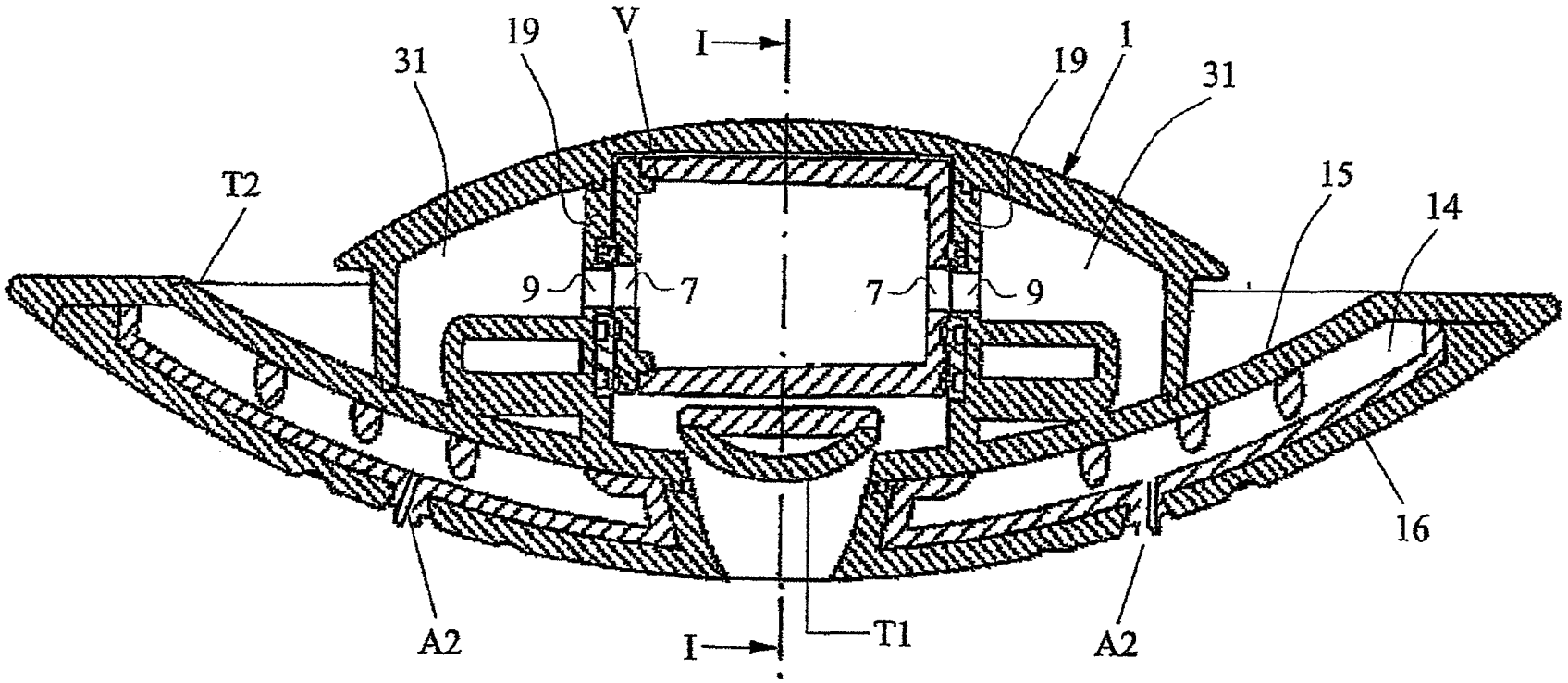
Figure 4:
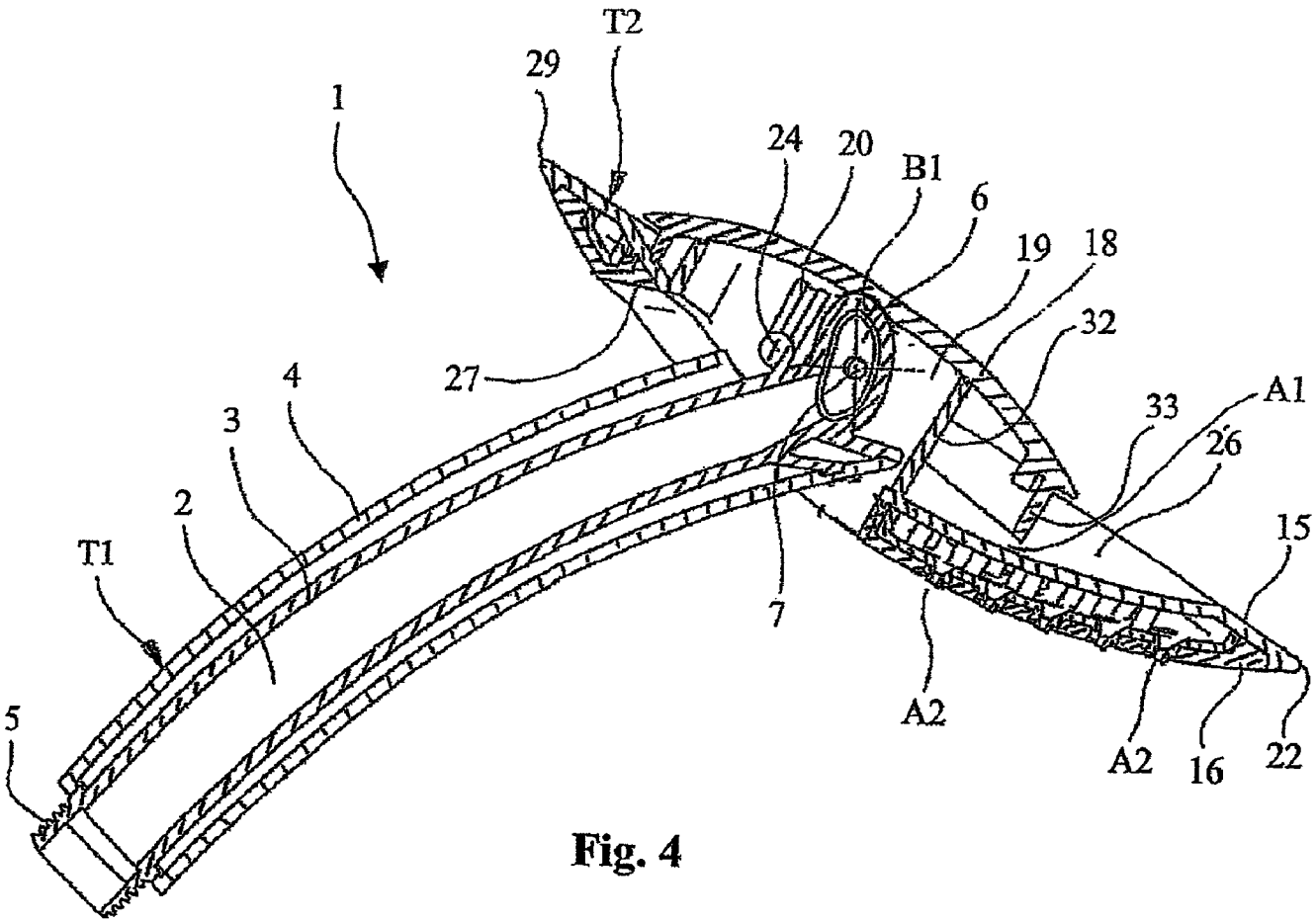

An exemplary embodiment of the invention is explained in more detail below on the basis of the drawing, in which:

FIG. 1 shows a section through a spray attachment according to the invention along the line I-I of FIG. 2, FIG. 2 shows a section along the line II-II of FIG. 1, FIG. 3 shows a section corresponding to FIG. 2, but after switching over of the valve, and FIG. 4 shows a section corresponding to FIG. 1 through the spray attachment according to the invention, but after switching over of the valve.

The spray attachment 1 shown in FIG. 1 is a shower spray attachment and has a first part T1 and a second part T2. The first part T1 has in a tubular housing 4 a water guiding tube 3, which forms a water guiding channel 2. At one end, the water guiding tube 3 has a thread 5, to which a water conduit not shown here, for example a flexible hose, is to be connected. The direction of flow of the water is indicated by the arrow 25. By means of a valve V, which is a switchable valve, water is supplied to the second part T2. This second part T2 has on an underside of a shell 21 a plurality of second outlet openings A2, which are formed as nozzles and with which a spray jet can be formed. The second part T2 consequently forms a spray head.

The second part T2 has an upper part 15 and a lower part 16, between which there is a space 14, which is connected to the second outlet openings A2. Molded onto the lower part 16 in this space 14 is a rubber-elastic insert 17, through which the exit openings A2 are formed. The upper part 15 forms a shell 21, with an overflow edge 22. The shell 21 forms an upwardly open space 26, into which a first exit opening A1 opens. Mounted from above on the upper part 15 is a hood-shaped cover 18, which is releasably interlocked with the upper part 15. A cylindrical collar 32 molded onto the upper part 15 lies on its inside against the cover 18 and, according to FIG. 4, is surrounded at a radial distance by a skirt 33, which is molded onto the cover 18 and extends downward. Molded onto the underside of the cover 18 is a supporting part 20, which rests on a spindle 24, which is molded onto the upper side of the water guiding tube 3. As FIG. 1 shows, the second part T2 has on the underside an opening 27, in which the first part T1 engages from below with a front end. The opening 27 is dimensioned in such a way that the second part T2 is pivotable to a limited extent about the spindle 24. The angle by which the second part T2 is pivotable is preferably less than 90°, preferably less than 45°. In FIG. 1, the second part T2 is shown in the upper pivoted position. The pivoting movement by which the second part T2 can be pivoted downward about the spindle 24 and into the position shown in FIG. 4 is indicated by the arrow 28. In such a pivoting movement, the overflow edge 22 is moved downward. In such a pivoting movement, a rear edge 29 correspondingly moves downward according to arrow 30. This pivoting movement is limited.

The valve V is formed by a region BE of the part T1 and a region B2 of the part T2. Both regions B1 and B2 are located inside the second part T2. According to FIG. 1, the region B1 is possibly oval in cross section and is molded onto the upper end of the water guiding tube 3. It has laterally two exit openings 7, which can also be seen in FIGS. 2 and 3. These exit openings 7 are, for example, circular openings, which lead out laterally from a space 6 (FIG. 2). The direction of flow through the exit openings 7 consequently runs substantially at right angles to the direction of flow of the water guiding channel 2. One of these exit openings 7 is formed through a wall 12, which is mounted in the manner of a cover in an opening 13 of a wall 11. If the second part T2 is in the upper pivoted position according to FIG. 1, the exit openings 7 are respectively in connection with an entry opening 8, as is shown in FIG. 2. These entry openings 8 are formed by two sliders 19 running parallel to each other, as FIG. 2 shows. The entry openings 8 lead into the already mentioned space 14, which is connected to the second outlet openings A2. Sealing means 10 serve for sealing the sliders 19 with respect to the region B1. These sealing means 10, preferably formed in a rubber-elastic manner, are inserted in recesses of the sliders 19. They are formed in such a way that the region B1 is displaceable along the inner side of the sliders 19.

If the second part T2 is in the upper pivoted position shown in FIGS. 1 and 2, and water flows in through the water guiding channel 2 in the direction of the arrow 25, it enters the space 6 of the region B1 and passes from the latter through the openings 7 and 8 into the space 14, and finally downward through the second outlet opening A2 as a spray jet.

According to FIG. 2, the sliders 19 form second entry openings 9, which are arranged above the entry openings 8 and, in the position of the first part T1 according to FIGS. 1 and 2, are closed by the region B1. If, as mentioned above, the second part T2 is then pivoted about the spindle 24, the second entry openings 9 move downward into the position shown in FIGS. 3 and 4. The region B1 thereby moves along the sliders 19 into a space 23, which is formed by the sliders 19 and the cover 18. In this position, the two entry openings 9 are connected to the exit openings 7 and the first entry openings 8 are closed by the region B1. These second entry openings 9 are connected to a space 31, which is formed by the cover 18 and the upper part 15. This space 31 leads downward into the shell 21 or into the upwardly open space 26.

If the second part T2 is in the second pivoted position, shown in FIGS. 3 and 4, and water flows in through the water guiding channel 2, it again enters the space 6, which is formed by the region B1 of the first part T1. In turn, the water flows laterally through the exit openings 7, but now outward through the second entry openings 9 into the space 31. From the latter, the water flows through the first outlet opening A1 into the space 26. Since the overflow edge 22 is offset downward with respect to the horizontal plane and the edge 29 is offset upward, the water flows out of the space 26 over the overflow edge 22 downward in a surge. If the second part T2 is pivoted counterclockwise back into the position shown in FIG. 1, the second entry openings 9 are again closed by the wall 11 and 12, and the exit openings 7 are connected to the entry openings 8. The water then flows again through the second outlet openings A2 and no longer through the first outlet openings A1 to the outside. The valve V is consequently formed by the two parts T1 and T2 or the regions B1 and B2. The switching over of the valve V takes place by a relative movement between the parts T1 and T2. Here the first part T1 is preferably fixed, for example fixedly connected to a wall of a building. In the case of the exemplary embodiment shown, the relative movement is a pivoting movement about the spindle 24, which is arranged at a distance from the exit opening 7. An embodiment with a linear or other movement, and in particular a tipping movement, is also conceivable. In the case of a linear movement, the spindle 24 is replaced by linear guiding elements. Horizontal or vertical pushing movements are conceivable here, for example. Actuating elements such as buttons or the like are not required here, since the second part T2 can be directly grasped and pivoted by hand.

The assembly of the spray attachment 1 according to the invention and its production are very simple, since these two parts T1 and T2 can be produced from a very small number of sturdy parts that can be produced by the injection-molding process. The valve V can be produced with comparatively small spatial dimensions. It is advantageous here in particular that the water flowing into the space 6 is distributed between two exit openings 7 and two entry openings 8 and 9. The cross sections of these openings can therefore be chosen to be comparatively small.

LIST OF DESIGNATIONS

1 spray attachment
2 water guiding channel
3 water guiding tube
4 housing
5 thread
6 space
7 exit opening
8 first entry opening
9 second entry opening
10 sealing means
11 wall
12 wall
13 opening
14 space
15 upper part
16 lower part
17 insert
18 cover
19 slider
20 supporting part
21 shell
22 overflow edge
23 space
24 spindle
25 arrow
26 space
27 opening

28 arrow
29 edge
30 arrow
31 space
32 collar
33 skirt
A1 first outlet opening
A2 second outlet opening
B1 region
B2 region
T2 second part
V valve

The invention claimed is:

1. A spray attachment comprising a first part, which is to be connected to a water conduit and has a water guiding channel, and comprising a second part, which has at least a first and a second outlet opening, which can be selectively connected to the water guiding channel of the first part by means of a valve, wherein the first part engages in the second part and wherein the valve is arranged inside the second part, the valve being able to be switched over by a pivoting movement of the second part with respect to the first part, and wherein the first part forms a pivot spindle for the pivoting of the second part and has at least one exit opening at a distance from said spindle, and wherein the second part has at least two entry openings, likewise at a distance from this pivot spindle.

2. The spray attachment as claimed in claim 1, wherein the first part has one exit openings, which is connected to the water guiding channel, and wherein the second part has two entry openings, which are able to be connected to said one exit opening of the first part.

3. The spray attachment as claimed in claim 1, wherein the valve has a valve part with at least one exit opening and wherein the second part has a valve part with at least one entry opening and wherein the two valve parts are displaceable or pivotable with respect to each other.

4. The spray attachment as claimed in claim 3, wherein said at least one entry opening of the valve has sealing means.

5. The spray attachment as claimed in claim 1, wherein the second part has an opening in which a front end of the first part engages.

6. The spray attachment as claimed in claim 5, wherein the valve is arranged inside said opening of the second part.

7. A spray attachment comprising a first part, which is to be connected to a water conduit and has a water guiding channel, and comprising a second part, which has at least a first and a second outlet opening, which can be selectively connected to the water guiding channel of the first part by means of a valve, wherein the first part engages in the second part and wherein the valve is arranged inside the second part, the valve being able to be switched over by a movement of the second part with respect to the first part, wherein for switching over the valve, the second part is pivoted about a spindle, which runs substantially perpendiculary in relation to the direction of flow of the water in the water guiding channel.

8. The spray attachment as claimed in claim 1, wherein for switching over the valve, the second part is pivoted by an angle that is less than 90°.

9. The spray attachment as claimed in claim 1, wherein the second part forms a spray head and wherein the valve can be switched over by movement of the spray head.

10. The spray attachment as claimed in claim 1, wherein said movement is a tipping movement.

11. The spray attachment as claimed in claim 7, wherein the first part has one exit opening, which is connected to the water guiding channel, and wherein the second part has two entry openings, which are able to be connected to said one exit opening of the first part.

12. The spray attachment as claimed in claim 7, wherein the valve has a valve part with at least one exit opening and wherein the second part has a valve part with at least one entry opening and wherein the two valve parts are displaceable or pivotable with respect to each other.

13. The spray attachment as claimed in claim 12, wherein said at least one entry opening of the valve has sealing means.

14. The spray attachment as claimed in claim 7, wherein the second part has an opening in which a front end of the first part engages.

15. The spray attachment as claimed in claim 14, wherein the valve is arranged inside said opening of the second part.

16. The spray attachment as claimed in claim 7, wherein for switching over the valve, the second part is pivoted by an angle that is less than 90°.

17. The spray attachment as claimed in claim 7, wherein the second part forms a spray head and wherein the valve can be switched over by movement of the spray head.

18. The spray attachment as claimed in claim 7, wherein said movement is a tipping movement.

19. The spray attachment as claimed in claim 1, wherein the first part has two exit openings, which are connected to the water guiding channel, and wherein the second part has four entry openings, which are able to be connected to said two exit openings of the first part.

20. The spray attachment as claimed in claim 8, wherein the second part is pivoted by an angle that is less than 45°.

21. The spray attachment as claimed in claim 20, wherein the second part is pivoted by an angle that is approximately 30°.

22. The spray attachment as claimed in claim 16, wherein the second part is pivoted by an angle that is less than 45°.

23. The spray attachment as claimed in claim 22, wherein the second part is pivoted by an angle that is approximately 30°.

* * * * *